US009249688B2

(12) United States Patent
Matsumura et al.

(10) Patent No.: US 9,249,688 B2
(45) Date of Patent: Feb. 2, 2016

(54) ROTARY MACHINE DRIVE SYSTEM

(71) Applicant: Kobe Steel, Ltd., Kobe-shi (JP)

(72) Inventors: Masayoshi Matsumura, Takasago (JP); Shigeto Adachi, Takasago (JP); Yutaka Narukawa, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 72 days.

(21) Appl. No.: 14/045,111

(22) Filed: Oct. 3, 2013

(65) Prior Publication Data

US 2014/0150432 A1 Jun. 5, 2014

(30) Foreign Application Priority Data

Dec. 4, 2012 (JP) ..... 2012-265061

(51) Int. Cl.
*F01K 13/00* (2006.01)
*F01K 23/00* (2006.01)

(52) U.S. Cl.
CPC ..... *F01K 23/00* (2013.01); *F01K 13/00* (2013.01)

(58) Field of Classification Search
CPC ..... F01K 23/00; F01K 23/02; F01K 13/00; F01K 13/02; F01K 25/10; F01K 23/065
USPC ..... 60/676, 645, 670, 692, 719
See application file for complete search history.

(56) References Cited

U.S. PATENT DOCUMENTS

| | | | | |
|---|---|---|---|---|
| 3,007,306 | A * | 11/1961 | Martin et al. | 60/655 |
| 2011/0072818 | A1* | 3/2011 | Cook | 60/645 |
| 2012/0073295 | A1* | 3/2012 | Enokijima et al. | 60/660 |
| 2013/0312414 | A1* | 11/2013 | Palmer | 60/645 |

FOREIGN PATENT DOCUMENTS

| | | | |
|---|---|---|---|
| CN | 102536363 | A | 7/2012 |
| JP | 2002-195100 | A | 7/2002 |
| JP | 2004-339965 | | 12/2004 |
| JP | 2005-282363 | A | 10/2005 |
| JP | 2007-127060 | A | 5/2007 |
| JP | 2012-149541 | A | 8/2012 |

* cited by examiner

*Primary Examiner* — Jesse Bogue
*Assistant Examiner* — Kelsey Stanek
(74) *Attorney, Agent, or Firm* — Oblon, McClelland, Maier & Neustadt, L.L.P.

(57) ABSTRACT

A rotary machine drive system includes: a first heat source heat exchanger that receives a first heating medium and gasifies a liquid working medium; a first expander that is connected to a rotation shaft and rotates the rotation shaft by expanding the working medium that has been gasified by the first heat source heat exchanger; a rotary machine that has a rotor part provided to the rotation shaft; a second heat source heat exchanger that receives a second heating medium and gasifies a liquid working medium; a second expander that is connected to the rotation shaft and rotates the rotation shaft by expanding the second heating medium; and a condenser that condenses the working medium that has been used in the first expander and the working medium that has been used in the second expander.

2 Claims, 7 Drawing Sheets

ROTARY MACHINE DRIVE SYSTEM

BACKGROUND OF THE INVENTION

1. Field of the Invention

The present invention relates to a rotary machine drive system.

2. Description of the Related Art

Conventionally, as disclosed in JP 2004-339965 A, for example, a rotary machine drive system has been known that recovers exhaust heat from various facilities such as a plant and drives a rotary machine using energy of the recovered exhaust heat. The disclosed rotary machine drive system includes a circulation circuit through which a working medium circulates and a power generator as a rotary machine. The circulation circuit includes an evaporator that evaporates the working medium using the exhaust heat, an expander that expands the working medium that has been evaporated by the evaporator, a condenser that condenses the working medium that has been expanded by the expander, and a pump that delivers the working medium that has been condensed by the condenser to the evaporator, all of which is connected in series. The power generator is driven by the working medium expanding in the expander. In addition, it is described that the power generator generates a high pressure steam using a heat source of a relatively low temperature such as exhaust warm water of 100 to 150° C.

SUMMARY OF THE INVENTION

According to the related art, when there are a plurality of heat sources available as heating medium, a plurality of rotary machine drive systems corresponding to the plurality of heat sources must be provided. This leads to an increase of the whole size of the power generation facility including the rotary machine drive systems, and further the cost increases.

Furthermore, in the related art, because the evaporator that evaporates the working medium is configured to use the exhaust heat, an amount of the steam generation from the evaporator depends on an amount of the exhaust warm water that is introduced from the outside. Thus, when the amount of the introduced exhaust warm water (exhaust heat amount) is changed, the driving amount of the power generator (rotary machine) coupled to a drive shaft of the expander is affected thereby.

The present invention has been made in the view of the related art, and it is an object of the invention to reduce the size of the rotary machine drive system and to reduce the cost. It is another object of the invention to suppress the change of the driving amount of the rotary machine even when heat input amount is changed.

In order to achieve the above objects, the present invention provides rotary machine drive system comprising: a first heat source heat exchanger that receives a first heating medium and gasifies a liquid working medium; a first expander that is connected to a rotation shaft and rotates the rotation shaft by expanding the working medium that has been gasified by the first heat source heat exchanger; a rotary machine that has a rotor part provided to the rotation shaft; a second heat source heat exchanger that receives a second heating medium and gasifies a liquid working medium; a second expander that is connected to the rotation shaft and rotates the rotation shaft by expanding the second heating medium; and a condenser system that condenses the working medium that has been used in the first expander and the working medium that has been used in the second expander.

According to the present invention, the working medium is heated by the first heating medium in the first heat source heat exchanger to be gasified, and the working medium that has been gasified in the first source heat exchanger is expanded by the first expander to rotate the rotation shaft. Meanwhile, the working medium is heated by the second heating medium in the second heat source heat exchanger to be gasified, and the working medium that has been gasified in the second heat source heat exchanger is expanded by the second-expander to rotate the rotation shaft. By thus connecting the first expander and the second expander respectively to the rotation shaft that rotates the rotor part of the rotary machine, the rotary machine can be driven using heat energy of a plurality of heating media. This can reduce the size of the rotary machine drive system and also reduce the cost thereof. Furthermore, because the first expander and the second expander are respectively connected to the rotation shaft that rotates the rotor part of the rotary machine, the rotary machine can be driven also by the heat input amount from the second heating medium to the working medium even if the heat input amount from the first heating medium to the working medium is changed, which can suppress the change of the driving amount due to the rotary machine being affected by the change of the heat input amount from the first heating medium to the working medium. Similarly, even if the heat input amount from the second heating medium to the working medium is changed, the heat input amount from the first heating medium to the working medium can prevent the change of the driving amount.

The rotary machine drive system may be provided with a flow rate adjusting unit that adjusts a flow rate of the working medium flowing into the first heat source heat exchanger and a flow rate of the working medium flowing into the second heat source heat exchanger.

Here, a heat amount of the first heating medium flowing into the first heat source heat exchanger may be greater than a heat amount of the second heating medium flowing into the second heat source heat exchanger. In this case, the flow rate adjusting unit adjusts the flow rate of the working medium so that a greater amount of the working medium flows into the first heat source heat exchanger than the working medium flowing into the second heat source heat exchanger.

The condenser system may be configured by a condenser that condenses the working medium that has been used in the second expander, in addition to the working medium that has been used in the first expander. In this aspect, the number of condenser is minimized, which can simplify the configuration of the rotary machine drive system.

The condenser system may include a first condenser that condenses the working medium that has been used in the first expander and a second condenser that condenses the working medium that has been used in the second expander. In this aspect, the first condenser and the second condenser can be independently designed based on the heat input amount to the first heat source heat exchanger and the heat input amount to the second heat source heat exchanger, respectively. This enables optimization of the rotary machine drive system.

As described above, the present invention makes it possible to suppress the change of the driving amount of the rotary machine even when the heat input amount is changed, in addition to reduce the size of the rotary machine drive system.

DESCRIPTION OF THE PREFERRED EMBODIMENTS

Hereinafter, embodiments of the present invention will be described with reference to the drawings.

First Embodiment

Figure 1:
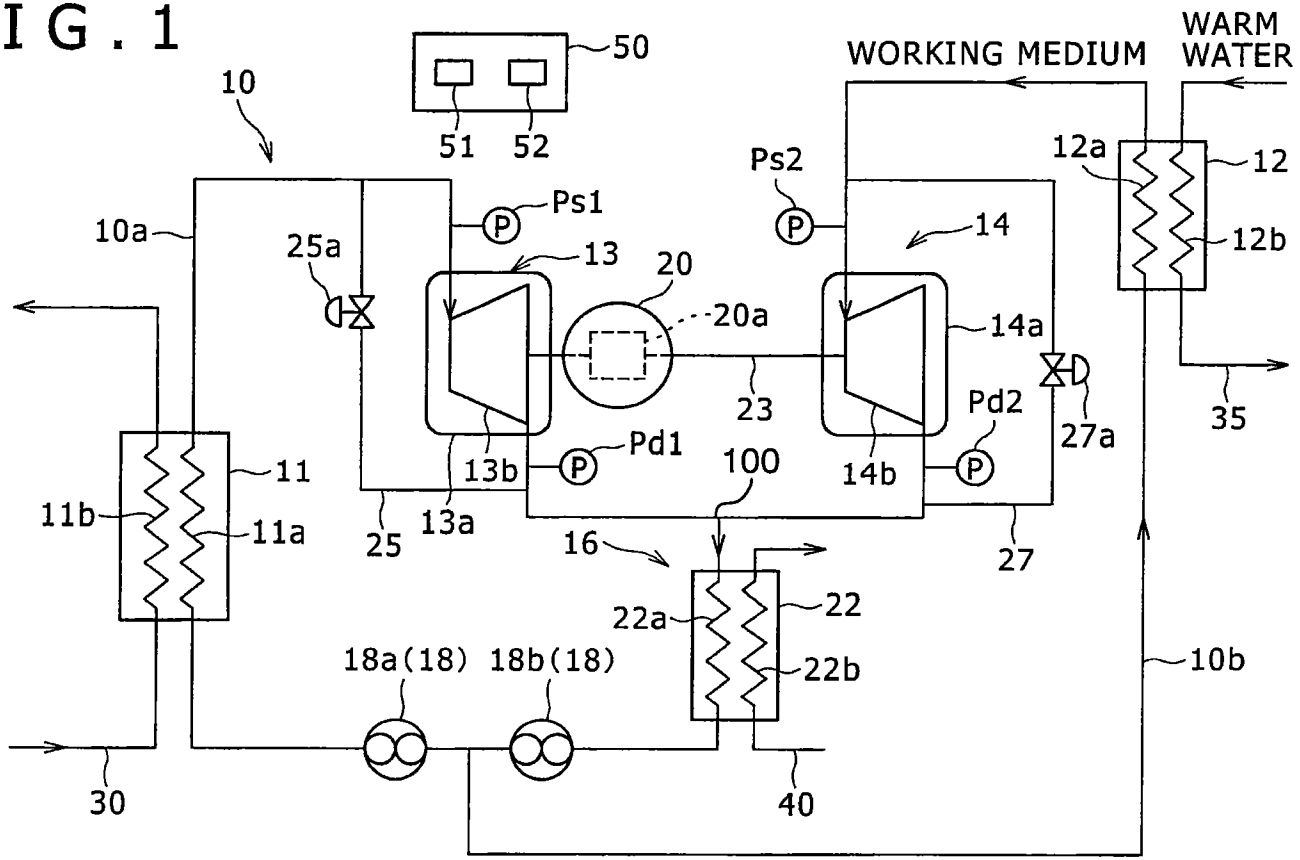
FIG. 1 is a schematic configuration diagram of a rotary machine drive system according to a first embodiment of the present invention.

FIG. 1 shows a configuration of a rotary machine drive system according to a first embodiment. Specifically, the rotary machine drive system includes a circulation circuit 10 that is a binary cycle engine through which a working medium circulates, a power generator 20 that is a rotary machine, and a control unit 50 that performs various controls. It should be noted that the working medium with a boiling point lower than that of water (for example, HFC245fa) circulates in the circulation circuit 10.

Connected to the circulation circuit 10 are a first heat source heat exchanger 11 that gasifies the working medium, a second heat source heat exchanger 12 that gasifies the working medium, a first expander 13 that expands the working medium in a gaseous state, a second expander 14 that expands the working medium in a gaseous state, a condenser system 16 that condenses the working medium that has been expanded by the first expander 13 and the second expander 14, and a pump system 18 that delivers the working medium that has been condensed by the condenser system 16 to the first heat source heat exchanger 11.

According to the first embodiment, the condenser system 16 is configured by a single condenser 22, and the pump system 18 includes a first pump 18*a* and a second pump 18*b*.

More specifically, the circulation circuit 10 includes a first circuit 10*a* and a second circuit 10*b* connected to the first circuit 10*a*. The first circuit 10*a* is provided with the first heat source heat exchanger 11, the first expander 13, the condenser 22 configuring the condenser system 16, and the first pump 18*a* and the second pump 18*b* that configure the pump system 18. The second circuit 10*b* is provided with the second heat source heat exchanger 12 and the second expander 14. One end of the second circuit 10*b* is connected between the first expander 13 and the condenser 22 in the first circuit 10*a*. The other end of the second circuit 10*b* is connected between the first pump 18*a* and the second pump 18*b* in the first circuit 10*a*.

The first heat source heat exchanger 11 gasifies a liquid working medium by the heat of a first heating medium. The first heat source heat exchanger 11 has a working medium flow path 11*a* through which the working medium flows and a heating medium flow path 11*b* through which the first heating medium flows. The heating medium flow path 11*b* is connected to a first heating medium circuit 30, and the first heating medium flows therethrough. The working medium flowing through the working medium flow path 11*a* exchanges heat with the first heating medium flowing through the heating medium flow path 11*b*, and then evaporates.

The first heating medium supplied by the first heating medium circuit 30 may include, for example, steam collected from an ore chute (steam well), steam discharged from a plant or the like, in addition to steam generated by a solar collector using solar heat as a heat source, steam generated from exhaust heat of an engine, a compressor, or the like, and steam generated from a boiler using biomass and fossil fuel as a heat source. The temperature of the first heating medium introduced to the first heat source heat exchanger 11 is, for example, 105 to 250° C.

The first expander 13 is provided downstream from the first heat source heat exchanger 11 in the circulation circuit 10, and extracts energy from the working medium by expanding the working medium that has been evaporated by the first heat source heat exchanger 11. In this embodiment, a screw expander is used as the first expander 13. In the screw expander, a pair of male and female screw rotors 13*b* are housed in a rotor chamber (not shown) formed in a casing 13*a* of the first expander 13. In the screw expander, the screw rotors 13*b* are rotated by expansion force of the working medium supplied from an inlet formed in the casing 13*a* to the rotor chamber. The working medium of which pressure has been lowered by being expanded in the rotor chamber is then discharged from an outlet formed in the casing 13*a*. The screw rotor 13*b* is connected to a rotation shaft 23. In other words, the rotation shaft 23 is connected to one of the screw rotors 13*b* of the first expander 13. The rotation shaft 23 rotates when the screw rotor 13*b* is driven by the working medium expanding in the first expander 13. It should be noted that the first expander 13 is not limited to the screw expander but may be configured by any other expander such as a turbine expander.

The second heat source heat exchanger 12 gasifies a liquid working medium by the heat of a second heating medium. The second heat source heat exchanger 12 has a working medium flow path 12*a* through which the working medium flows and a heating medium flow path 12*b* through which the second heating medium flows. The heating medium flow path 12*b* is connected to a second heating medium circuit 35, and the second heating medium flows therethrough. The working medium flowing through the working medium flow path 12*a* exchanges heat with the second heating medium flowing through the heating medium flow path 12*b*.

The second heating medium supplied from the second heating medium circuit 35 may include, for example, warm water. The second heating medium introduced to the second heat source heat exchanger 12 is, for example, 80 to 100° C. It means that the temperature of the second heating medium is lower than that of the first heating medium. It should be noted that the second heating medium may be steam, such as water vapor, with the same temperature range as the first heating medium. The second heating medium may also be a heating medium hotter than the first heating medium. For example, the second heating medium may be steam and the first heating medium may be warm water.

The second expander 14 is provided downstream from the second heat source heat exchanger 12 in the second circuit 10*b* of the circulation circuit 10, and extracts energy from the working medium by expanding the working medium that has been evaporated by the second heat source heat exchanger 12.

In this embodiment, a screw expander is used as the second expander 14. In the screw expander, a pair of male and female screw rotors 14*b* are housed in a rotor chamber (not shown) formed in a casing 14*a* of the second expander 14. In the screw expander, the screw rotors 14*b* are rotated by the expansion force of the working medium supplied from an inlet formed in the casing 14*a* to the rotor chamber. The working medium of which pressure has been lowered by being expanded in the rotor chamber is then discharged from an outlet formed in the casing 14*a*. The screw rotor 14*b* is connected to the rotation shaft 23. In other words, the rotation shaft 23 is connected to one of the screw rotors 14*b* of the second expander 14. The rotation shaft 23 rotates when the screw rotor 14*b* is driven by the working medium expanding in the second expander 14. It should be noted that the second expander 14 is not limited to the screw expander but may be configured by any other expander such as a turbine expander.

The condenser system 16 condenses the gaseous working medium discharged from the first expander 13 and the second expander 14 into the liquid working medium. In the first embodiment, as described above, the condenser system 16 is configured by the single condenser 22. The flows of working medium discharged by the first and second expanders 13 and 14 are joined at a joining portion 100 (FIG. 1) to form a common flow of working medium that has been expanded in both the first expander and the second expander, which common flow is received by the condenser 22.

The condenser 22 has a working medium flow path 22*a* through which the gaseous working medium flows and a cooling medium flow path 22*b* through which cooling medium flows. The working medium that has been expanded by being used for driving the rotor 13*b* in the first expander 13 and the working medium that has been expanded by being used for driving the rotor 14*b* in the second expander 14 flow into the working medium flow path 22*a*.

The cooling medium flow path 22*b* is connected to a cooling medium circuit 40, and the cooling medium supplied from the outside flows therethrough. The cooling medium may include, for example, cooling water cooled in a cooling tower. The working medium flowing through the working medium flow path 22*a* is condensed by exchanging heat with the cooling medium flowing through the cooling medium flow path 22*b*.

The pump system 18 is used to circulate the working medium in the circulation circuit 10, and provided downstream from the condenser 22 in the first circuit 10*a* (between the first heat source heat exchanger 11 and the condenser 22). As described above, the pump system 18 includes the first pump 18*a* and the second pump 18*b*. The first pump 18*a* is provided downstream from the second pump 18*b*. Therefore, the second pump 18*b* suctions the liquid working medium that has been condensed by the condenser 22 and pressurizes the working medium to discharge it. The first pump 18*a* suctions a part of the working medium discharged from the second pump 18*b*. The first pump 18*a* then pressurizes the suctioned working medium to a predetermined pressure and discharges it. The liquid working medium discharged by the first pump 18*a* is introduced into the first heat source heat exchanger 11. The remaining portion of the working medium discharged from the second pump 18*b* flows into the second circuit 10*b* to be introduced into the second heat source heat exchanger 12. The second pump 18*b* may be provided in the second circuit 10*b*.

As the first pump 18*a* and the second pump 18*b*, a centrifugal pump having an impeller as a rotor or a gear pump of which rotor is configured by a pair of gears may be used. Such pumps 18*a*, 18*b* may be driven at any rotation speed.

The power generator 20 has a rotor part 20*a*, and the rotor part 20*a* is provided in an intermediate part of the rotation shaft 23 that connects one of the screw rotors 13*b* of the first expander 13 and one of the screw rotors 14*b* of the second expander 14. The rotation shaft 23 is rotated when the screw rotors 13*b* are driven by the expansion of the working medium in the first expander 13, and the rotation shaft 23 is also rotated when the screw rotors 14*b* are driven by the expansion of the working medium in the second expander 14. Accordingly, the rotor part 20*a* rotates. Along with the rotor part 20*a* rotating in association with the rotation of the rotation shaft 23, the power generator 20 generates electric power. In this embodiment, an IPM power generator (permanent magnet synchronous power generator) is used as the power generator. The rotation speed of the power generator 20 is adjustable using an inverter (not shown). The control unit 50 outputs a rotation speed adjustment signal to the inverter (not shown) to adjust the rotation speed of the power generator 20 so that the power generation efficiency of the power generator 20 becomes as high as possible. It should be noted that the power generator 20 is not limited to the IPM power generator but may be any other type of power generator such as, for example, an induction generator.

The first circuit 10*a* is provided with a first bypass passage 25. The first bypass passage 25 is provided with a bypass valve 25*a* configured by an on-off valve, and the first bypass passage 25 enables the working medium to bypass the first expander 13 in the first circuit 10*a* by opening the bypass valve 25*a*. One end portion of the first bypass passage 25 is connected to a piping between the first heat source heat exchanger 11 and the first expander 13 in the first circuit 10*a*, and the other end portion of the first bypass passage 25 is connected to a piping between the first expander 13 and the condenser 22 in the first circuit 10*a*.

The second circuit 10*b* is provided with a second bypass passage 27. The second bypass passage 27 is provided with a bypass valve 27*a* configured by an on-off valve, and the second bypass passage 27 enables the working medium to bypass the second expander 14 in the second circuit 10*b* by opening the bypass valve 27*a*. One end portion of the second bypass passage 27 is connected to a piping between the second heat source heat exchanger 12 and the second expander 14 in the second circuit 10*b*, and the other end portion of the second bypass passage 27 is connected to a piping between the second expander 14 and the end portion on the condenser 22 side in the second circuit 10*b*.

The first circuit 10*a* is provided with a first input side pressure sensor Ps1 and a first back pressure sensor Pd1. The first input side pressure sensor Ps1 is provided in the piping between the first heat source heat exchanger 11 and the first expander 13 of the piping configuring the first circuit 10*a*. The first back pressure sensor Pd1 is provided in the piping between the first expander 13 and the condenser 22 of the piping configuring the first circuit 10*a*.

The second circuit 10*b* is provided with a second input side pressure sensor Ps2 and a second back pressure sensor Pd2. The second input side pressure sensor Ps2 is provided in the piping between the second heat source heat exchanger 12 and the second expander 14 of the piping configuring the second circuit 10*b*. The second back pressure sensor Pd2 is provided in the piping between the second expander 14 and the end portion on the condenser 22 side of the piping configuring the second circuit 10*b*.

The control unit 50 includes a ROM, a RAM, a CPU, and the like and exerts a predetermined function by executing a program stored in the ROM. The function of the control unit 50 includes a pump control unit 51 and an open/close control unit 52.

The pump control unit 51 controls the rotation speed of the first pump 18*a* and the second pump 18*b*. Because the rotation speed of the first pump 18*a* and the second pump 18*b* are controlled by the inverter (not shown), the pump control unit 51 controls the rotation speed of the first pump 18*a* and the second pump 18*b* by transmitting a control signal to the inverter.

In this embodiment, the temperature of the first heating medium flowing into the first heat source heat exchanger 11 is higher than the temperature of the second heating medium flowing into the second heat source heat exchanger 12, and the heat amount of the first heating medium flowing into the first heat source heat exchanger is greater than the heat amount of the second heating medium flowing into the second heat source heat exchanger. Therefore, the pump control unit 51 adjusts the rotation speed of the first pump 18*a* and the second pump 18*b* so that a greater amount of the working medium flows into the first heat source heat exchanger 11 than the working medium flowing into the second heat source heat exchanger 12 during normal operation. In other words, the pump control unit 51 is exemplary illustrated as a flow rate adjusting unit that adjusts the flow rate of the working medium so that the flow rate of the working medium flowing into the first heat source heat exchanger 11 is greater than that flowing into the second heat source heat exchanger 12. The normal operation means an operation when the first heating medium and the second heating medium are introduced into the first heat source heat exchanger 11 and the second heat source heat exchanger 12 sufficiently to evaporate the working media.

The invention is not limited to the configuration of independently adjusting the rotation speeds of the pumps 18*a*, 18*b*. For example, it may be configured to drive the pumps 18*a*, 18*b* at the same rotation speed.

The open/close control unit 52 opens the bypass valve 27*a* in the second bypass passage 27 when the first expander 13 is driven by the working medium in the state where the second expander 14 is not driven or substantially not driven. Meanwhile, the open/close control unit 52 opens the bypass valve 25 in the first bypass passage 25 when the second expander 14 is driven by the working medium in the state where the first expander 13 is not driven or substantially not driven. By opening the bypass valves 25*a*, 27*a*, the screw rotors 14*b*, 13*b* are brought into a state that allows idling. This prevents an increase of a drive load onto one of the expanders 13, 14 by the liquid working medium being introduced into the other one of the expanders 13, 14.

Upon receiving an activation command of the pump system 18, the open/close control unit 52 opens the bypass valves 25*a*, 27*a*, then closes the bypass valve 25 in the first bypass passage 25 when a pressure difference obtained from a detection value of the first input side pressure sensor Ps1 and a detection value of the first back pressure sensor Pd1 reaches a predetermined threshold, and closes the bypass valve 27*a* in the second bypass passage 27 when the pressure difference obtained from a detection value of the second input side pressure sensor Ps2 and a detection value of the second back pressure sensor Pd2 reaches the predetermined threshold. The threshold of the pressure difference is set to a pressure that allows a sufficient amount of the working medium to be evaporated in the heat source heat exchangers 11, 12 and drive the expanders 13, 14.

The open/close control of the bypass valves 25*a*, 27*a* is not limited to the above example. For example, the back pressure sensors Pd1, Pd2 may be omitted, and the open/close control unit 52 may be adapted to open the bypass valves 25*a*, 27*a* upon receiving the activation command of the pump system 18, closes the bypass valve 25*a* when the detection value of the first input side pressure sensor Ps1 reaches the predetermined threshold, and close the bypass valve 27*a* when the detection value of the second input side pressure sensor Ps2 reaches the predetermined threshold. Moreover, the input side pressure sensors Ps1, Ps2 and the back pressure sensors Pd1, Pd2 may be omitted, and the bypass valves 25*a*, 27*a* may be closed when a predetermined period of time has passed after receiving the activation command for the pump system.

As described above, in this embodiment, the working medium is heated by the first heating medium to be gasified in the first heat source heat exchanger 11, and the working medium that has been gasified in the first heat source heat exchanger 11 expands in the first expander 13 to rotate the rotation shaft 23. Meanwhile, the working medium is heated and gasified by the second heating medium in the second heat source heat exchanger 12, and the working medium that has been gasified in the second heat source heat exchanger 12 expands in the second expander 14 to rotate the rotation shaft 23. By thus connecting the first expander 13 and the second expander 14 respectively to the rotation shaft 23 that rotates the rotor part 20*a* of the power generator 20, a single power generator 20 can use heat energy from a plurality of heating media. This can reduce the size of the rotary machine drive system and also reduce the cost.

Furthermore, because the first expander 13 and the second expander 14 are respectively connected to the rotation shaft 23 that rotates the rotor part 20*a* of the power generator 20, the power generator 20 may be driven by the heat input amount from the second heating medium to the working medium even if the heat input amount from the first heating medium to the working medium is changed, which can suppress the change of the driving amount due to the power generator 20 affected thereby. Alternatively, even if the heat input amount from the second heating medium to the working medium is changed, the power generator 20 may be driven by the heat input amount from the first heating medium to the working medium, which can suppress the change of the driving amount due to the power generator 20 affected thereby.

According to the first embodiment, the pump control unit 51 adjusts the flow rate of the working medium so that a greater amount of the working medium flows into the first heat source heat exchanger 11 than that flows into the second heat source heat exchanger 12. Thus, a greater amount of the working medium flows into the first heat source heat exchanger 11 which receives the greater amount of the heat input amount from the heating medium. This makes it possible to drive the power generator 20 more efficiently.

According to the first embodiment, the condenser system 16 is configured by the single condenser 22, which condenses the working medium that has been used in the second expander 14, in addition to the working medium that has been used in the first expander 13. This minimizes the number of the condenser 22, which simplifies the configuration of the rotary machine drive system.

Second Embodiment

Figure 2:
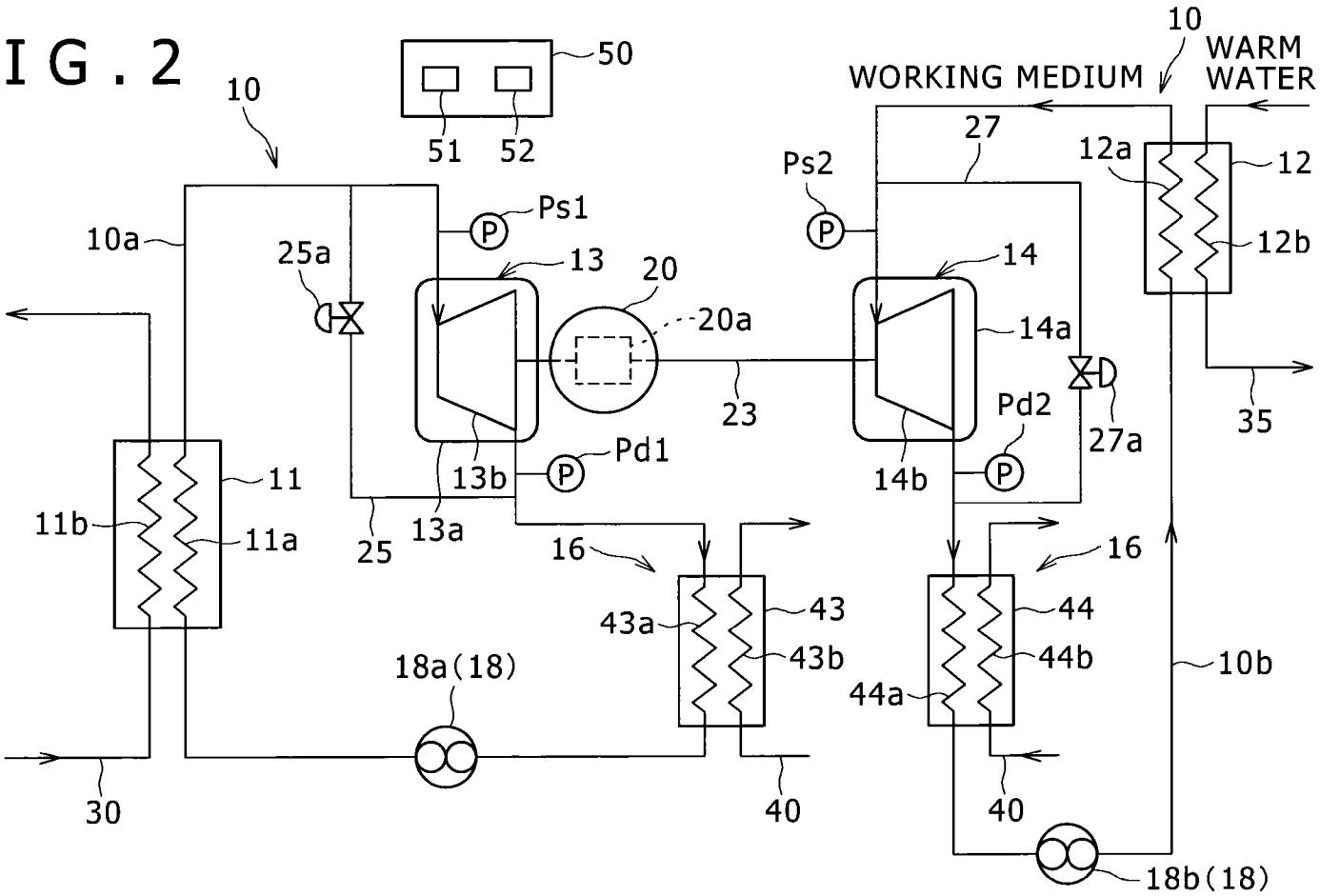
FIG. 2 is a schematic configuration diagram of a rotary machine drive system according to a second embodiment of the present invention.

FIG. 2 shows a second embodiment of the present invention. The same element is denoted by the same reference numeral as in the first embodiment and detailed description thereof is omitted here.

In the rotary machine drive system according to the first embodiment, the piping configuring the second circuit 10*b* is connected to the piping configuring the first piping 10*a*, and the working medium diverges and converges in the first circuit 10*a* and the second circuit 10*b* in the circulation circuit 10. Meanwhile, according to the second embodiment, the piping configuring the second circuit 10*b* is not connected to the piping configuring the first circuit 10*a*, and the first circuit 10*a* and the second circuit 10*b* are configured as closed circuits that are independent from each other. The working medium circulating in the first circuit 10*a* and the working medium circulating in the second circuit 10*b* may be the same working medium or different working media.

The condenser system 16 according to the second embodiment includes a first condenser 43 provided in the first circuit 10*a* and a second condenser 44 provided in the second circuit 10*b*. The first circuit 10*a* is provided with the first heat source heat exchanger 11, the first expander 13, the first condenser 43, and the first pump 18*a*; and the second circuit 10*b* is provided with the second heat source heat exchanger 12, the second expander 14, the second condenser 44, and the second pump 18*b*.

The first condenser 43 has a working medium flow path 43*a* through which the working medium flows and a cooling medium flow path 43*b* through which the cooling medium flows. The working medium that has been expanded by being used to drive the rotor 13*b* in the first expander 13 flows into the working medium flow path 43*a* of the first condenser 43.

The cooling medium flow path 43*b* is connected to the cooling medium circuit 40, through which the cooling medium supplied from the outside flows. The cooling medium may include, for example, cooling water cooled in a cooling tower. The working medium flowing through the working medium flow path 43*a* is condensed by exchanging heat with the cooling medium flowing through the cooling medium flow path 43*b*.

The second condenser 44 has a working medium flow path 44*a* through which the working medium flows and a cooling medium flow path 44*b* through which the cooling medium flows. The working medium that has been expanded by being used to drive the rotor 14*b* in the second expander 14 flows into the working medium flow path 44*a* of the second condenser 44.

The cooling medium flow path 44*b* is connected to the cooling medium circuit 40, through which the cooling medium supplied from the outside flows. The working medium flowing through the working medium flow path 44*a* is condensed by exchanging heat with the cooling medium flowing through the cooling medium flow path 44*b*. The cooling medium flow path 44*b* in the second condenser 44 may be connected to a cooling medium circuit other than the cooling medium circuit 40 connected to the cooling medium flow path 43*b* in the condenser 43.

According to the first embodiment, respective inflow amounts into the first heat source heat exchanger 11 and the second heat source heat exchanger 12 are determined based on the difference between the discharge amount of the working medium from the first pump 18*a* and the discharge amount of the working medium from the second pump 18*b*. Meanwhile, according to the second embodiment, the inflow amount of the working medium into the first heat source heat exchanger 11 is determined by the discharge amount of the working medium from the first pump 18*a*, and the inflow amount of the working medium to the second heat source heat exchanger 12 is determined by the discharge amount of the working medium from the second pump 18*b*.

The pump control unit 51 adjusts the rotation speed of the first pump 18*a* and the second pump 18*b* so that a greater amount of the working medium flows into the first heat source heat exchanger 11 than the working medium flowing into the second heat source heat exchanger 12 during normal operation. Instead of the configuration of adjusting the rotation speed, the first pump 18*a* and the second pump 18*b* may be selected so that the rated discharge amount of the first pump 18*a* is greater than that of the second pump 18*b*.

A control operation of the open/close control unit 52 is same as that of the open/close control unit 52 in the first embodiment.

In this embodiment, the first condenser 43 and the second condenser 44 can be independently designed based on the heat input amount to the first heat source heat exchanger 11 and the heat input amount to the second heat source heat exchanger 12, respectively. This enables optimization of the rotary machine drive system.

In the first embodiment and second embodiment, the first bypass passage 25, the second bypass passage 27, and the open/close control unit 52 may be omitted. Other configurations, operations, and effects are the same as those in the first embodiment, descriptions of which are omitted here.

Third Embodiment

Figure 3:
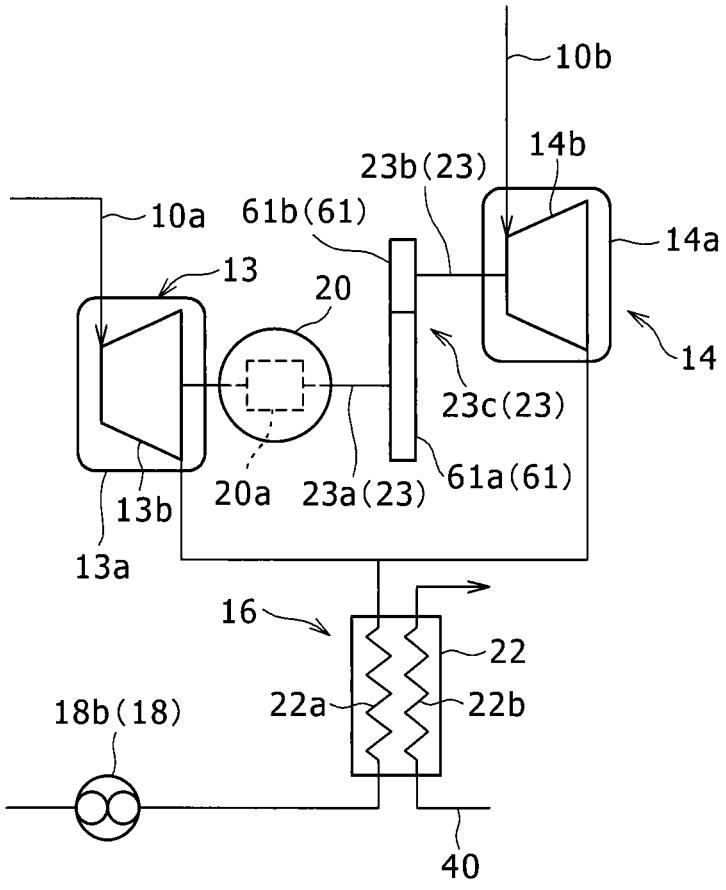
FIG. 3 is a partial schematic diagram of a rotary machine drive system according to a third embodiment of the present invention.

FIG. 3 shows only a part of a rotary machine drive system according to a third embodiment of the present invention. The same element is denoted by the same reference numeral as in the first embodiment and detailed description thereof is omitted here.

According to the first embodiment, the rotation shaft 23 is configured by a single shaft member. Meanwhile, according to the third embodiment, the rotation shaft 23 is separated into a first shaft part 23*a* and a second shaft part 23*b*, and includes a coupling part 23*c* coupling the first shaft part 23*a* and the second shaft part 23*b* to transmit the driving force therethrough.

The coupling part 23*c* is configured by an acceleration/deceleration mechanism 61 that converts the rotation speed between the first shaft part 23*a* and the second shaft part 23*b*. The acceleration/deceleration mechanism 61 has a first gear wheel 61*a* connected to the first shaft part 23*a* and a second gear wheel 61*b* connected to the second shaft part 23*b* and meshed with the first gear wheel 61*a*. In the illustrated example, the number of teeth of the first gear wheel 61*a* is greater than that of teeth of the second gear wheel 61*b*, but an opposite configuration may be employed as an alternative. Furthermore, although the power generator 20 is provided to the first shaft part 23*a* in the illustrated example, the power generator 20 may be provided to the second shaft part 23*b* as an alternative.

The first shaft part 23*a* is connected to the first expander 13 at one end portion. The other end portion of the first shaft part 23*a* is coupled to the first gear wheel 61*a*. The second shaft part 23*b* is connected to the second expander 14 at one end portion. The other end portion of the second shaft part 23*b* is coupled to the second gear wheel 61*b*.

The third embodiment can easily cope with a case in which the rotation speed of the first expander 13 is different from the rotation speed of the second expander 14. In other words, when the first expander 13 and the second expander 14 are configured by different types of expander of and have different rated rotation speeds, the rotation speed difference between them may be easily offset by providing the acceleration/deceleration mechanism 61 between the first shaft part 23*a* and the second shaft part 23*b*.

In the third embodiment, the first circuit 10*a* and the second circuit 10*b* may be configured as independent closed circuits and the condenser system 16 may include the first condenser 43 and the second condenser 44, as in the second embodiment. Furthermore, the first bypass passage 25, the second bypass passage 27, and the open/close control unit 52 may be omitted. Other configurations, operations, and effects are the same as those in the first embodiment, descriptions of which are omitted here.

Fourth Embodiment

Figure 4:
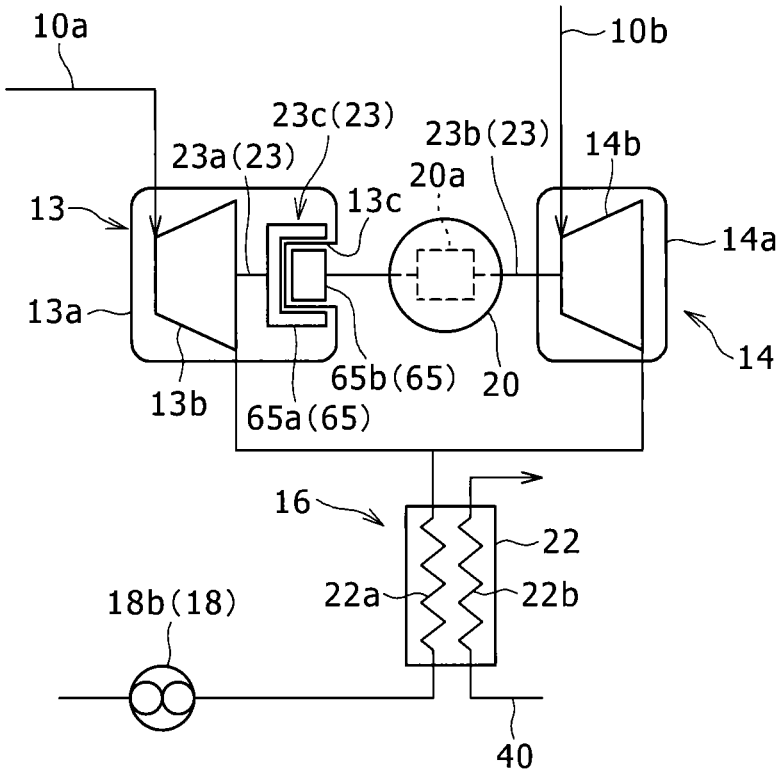
FIG. 4 is a partial schematic diagram of a rotary machine drive system according to a fourth embodiment of the present invention.

FIG. 4 shows only a part of a rotary machine drive system according to a fourth embodiment of the present invention. The same element is denoted by the same reference numeral as in the third embodiment and detailed description thereof is omitted here.

According to the third embodiment, the coupling part 23*c* is configured by the acceleration/deceleration mechanism 61. Meanwhile, according to the fourth embodiment, the coupling part 23*c* is configured by a magnetic coupling 65 that magnetically couples the first shaft part 23*a* and the second shaft part 23*b*.

Figure 5:
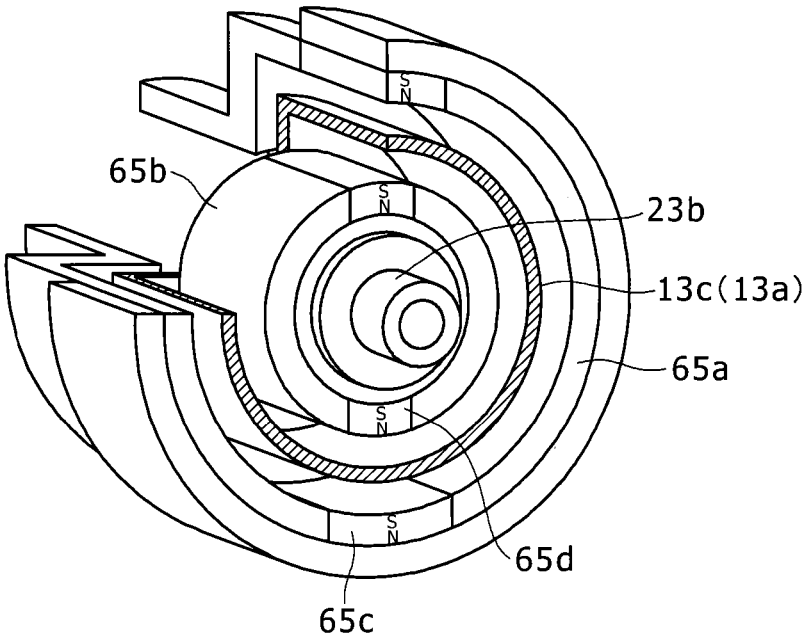
FIG. 5 is an illustration of a magnetic coupling provided in the rotary machine drive system.

As also shown in FIG. 5, the magnetic coupling 65 has an outer cylinder body 65*a* provided at the other end of the first shaft part 23*a* and an insert body 65*b* provided at the other end of the second shaft part 23*b*. The outer cylinder body 65*a* is formed into a bottomed cylinder opening toward the second shaft part 23*b* and formed by a non-magnetic material. At a portion formed into a cylinder of the outer cylinder body 65*a*, a plurality of driving-side magnets 65*c* (see FIG. 5) are independently arranged in a circumferential direction so as to facing each other.

The outer cylinder body 65*a* is housed in the casing 13*a* along with the screw rotor 13*b*, the casing 13*a* being a sealed body. Thus, the first shaft part 23*a* is also housed in the casing 13*a*. The first shaft part 23*a* is rotatably supported by a bearing (not shown) in the casing 13*a*. The casing 13*a* hermetically isolates the inside of the casing 13*a* from the outside of the casing 13*a*. The working medium that has been used in the circulation circuit 10 is also sealed inside the casing 13*a*.

The insert body 65*b* is formed into a cylinder shape and inserted into the outer cylinder body 65*a*. The insert body 65*b* is configured by a non-magnetic material as in the case of the outer cylinder body 65*a*. Attached to an outer peripheral surface of the insert body 65*b* (the outer peripheral surface of a portion inserted into the outer cylinder body 65*a*) are driven-side magnets 65*d* (see FIG. 5) of which number corresponds to the number of the driving-side magnets 65*c*. The driving-side magnets 65*c* and the driven-side magnets 65*d* are arranged so that opposite magnetic poles faces each other and a magnetic attraction force is induced through a partition (part of a wall configuring the casing 13*a*) 13*c* between the magnets 65*c*, 65*d*, thereby transmitting the rotation driving force of the first shaft part 23*a* to the second shaft part 23*b*.

According to the fourth embodiment, because the first shaft part 23*a* housed in the casing 13*a* is supported by the bearing in the casing 13*a*, it is possible to prevent leakage of a fluid such as a lubricating oil, the working medium, or the like to the outside through the bearing, and to drivingly connect the first shaft part 23*a* to the second shaft part 23*b* with the magnetic coupling 65.

Although the second shaft part 23*b* and the insert body 65*b* are not housed in the sealed body according to the fourth embodiment, the second shaft part 23*b* and the insert body 65*b* may be alternatively housed in the sealed body.

Although the outer cylinder body 65*a* of the magnetic coupling 65 is on the driving side and the insert body 65*b* is on the driven side according to the fourth embodiment, the insert body 65*b* may be on the driving side and the outer cylinder body 65*a* may be on the driven side, alternatively.

In the fourth embodiment, the first circuit 10*a* and the second circuit 10*b* may be configured as independent closed circuits and the condenser system 16 may include the first condenser 43 and the second condenser 44, as in the second embodiment. Furthermore, the first bypass passage 25, the second bypass passage 27, and the open/close control unit 52 may be omitted.

Other configurations, operations, and effects are the same as those in the second embodiment, descriptions of which are omitted here.

Fifth Embodiment

Figure 6:
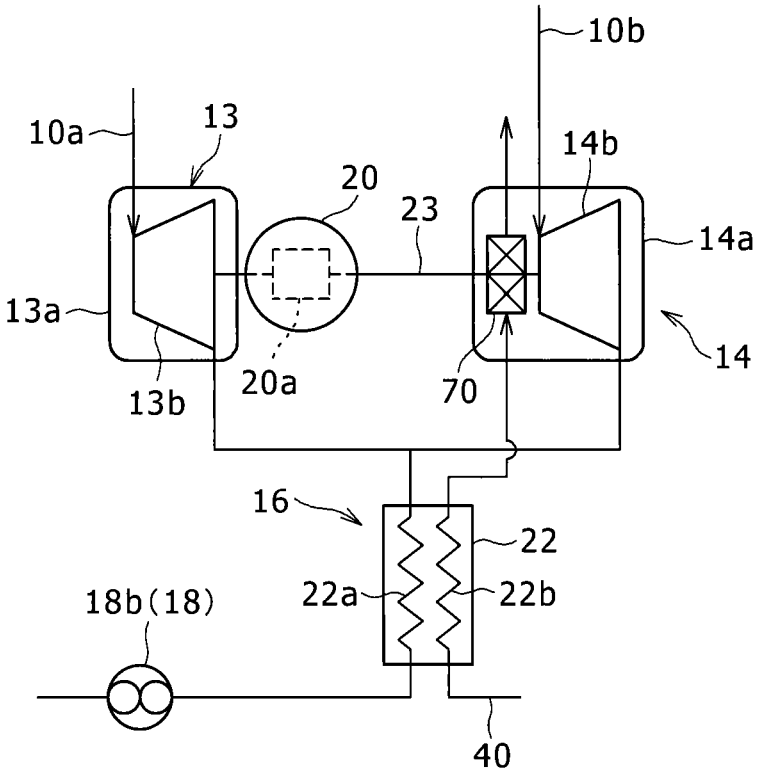
FIG. 6 is a partial schematic diagram of a rotary machine drive system according to a fifth embodiment of the present invention.

FIG. 6 shows only a part of a rotary machine drive system according to a fifth embodiment of the present invention. The same element is denoted by the same reference numeral as in the first embodiment and detailed description thereof is omitted here.

According to the fifth embodiment, the water that has been used in the condenser 22 is supplied to a bearing 70 of the rotation shaft 23 as a lubricant. In other words, in the cooling medium circuit 40, a flow path downstream from the condenser 22 is connected to the bearing 70 of the rotation shaft 23. Thus, the cooling medium that has been used to cool the working medium in the cooling medium flow path 22*b* of the condenser 22 is also used as the lubricant for the bearing 70. Although the illustrated example shows a configuration in which the cooling medium is introduced to the bearing 70 arranged in the second expander 14, the bearing 70 may not necessarily be arranged in the second expander 14.

According to the fifth embodiment, there is no need of using the lubricating oil, and it does not need time and effort to discard the lubricant (water).

In the fifth embodiment, the first circuit 10*a* and the second circuit 10*b* may also be configured as independent closed circuits and the condenser system 16 may include the first condenser 43 and the second condenser 44, as in the second embodiment. In such a case, the cooling medium that has been used in either of the first condenser 43 and the second condenser 44 may be introduced to the bearing 70. The first bypass passage 25, the second bypass passage 27, and the open/close control unit 52 may also be omitted.

Other configurations, operations, and effects are the same as those in the first embodiment, descriptions of which are omitted here.

Sixth Embodiment

Figure 7:
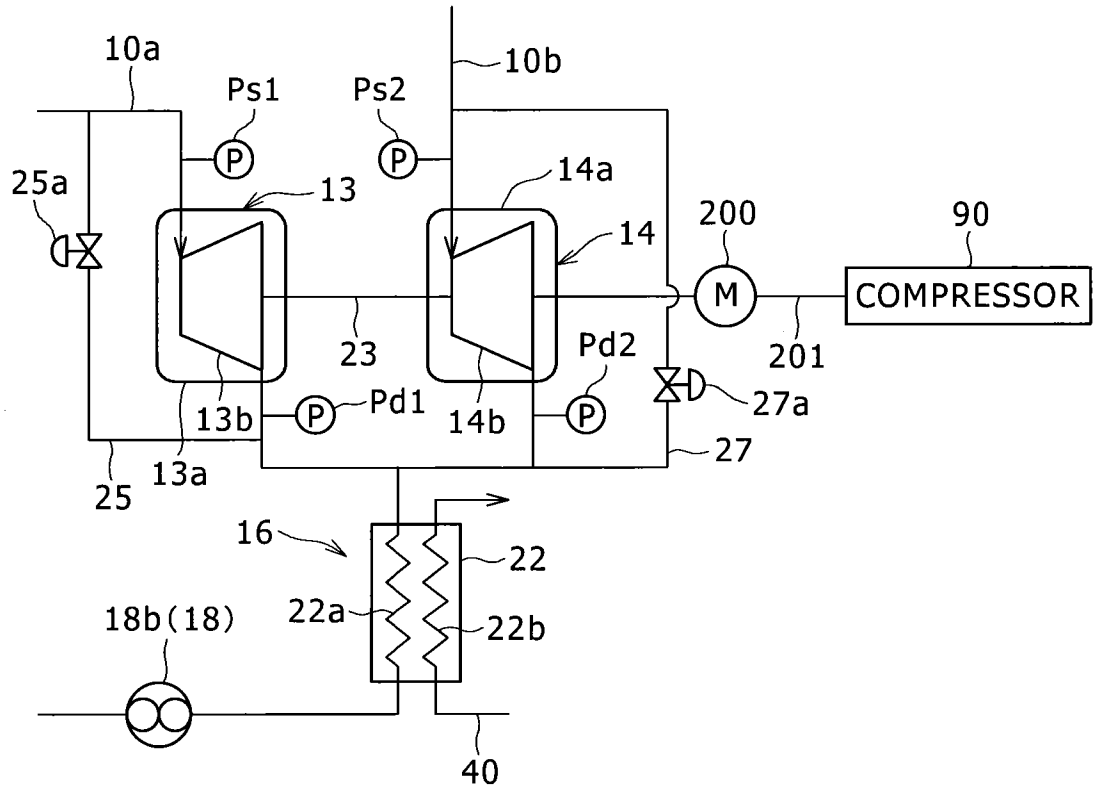
FIG. 7 is a partial schematic diagram of a rotary machine drive system according to a sixth embodiment of the present invention.

FIG. 7 shows only a part of a rotary machine drive system according to a sixth embodiment of the present invention. The same element is denoted by the same reference numeral as in the first embodiment and detailed description thereof is omitted here.

According to the sixth embodiment, a rotor part of a motor 200 is connected to the rotation shaft 23. In other words, the rotor part of the motor 200 is connected to the shaft member connected to the end portion opposite from the first expander 13 (on the right side in FIG. 7), namely the shaft member that is a part of the rotation shaft 23, in the screw rotor 14*b* of the second expander 14. The motor 200 is illustrated as a rotary machine. A shaft 201 of the motor 200 is connected to a compressor 90, and the compressor 90 is driven by the rotation of the motor 200. Other configurations are the same as those in the first embodiment. Upon driving the compressor 90, power of the first and second expanders 13, 14 is transmitted to the compressor 90 via the rotation shaft 23 and the shaft 201 connected to the rotation shaft 23. As a result, power consumption of the motor 200 can be reduced compared with a case of driving the compressor 90 by the motor 200 alone.

In the sixth embodiment, the first circuit 10*a* and the second circuit 10*b* may also be configured as independent closed circuits and the condenser system 16 may include the first condenser 43 and the second condenser 44, as in the second embodiment. The first bypass passage 25, the second bypass passage 27, and the open/close control unit 52 may also be omitted.

Other configurations, operations, and effects are the same as those in the first embodiment, descriptions of which are omitted here.

Other Embodiments

The present invention is not limited to the embodiments described above, but various alterations and modifications can be made without departing from the scope of the invention. For example, in each embodiment, the first heat source heat exchanger 11 and the second heat source heat exchanger 12 may each include an evaporation part that evaporates the working medium by heating it to approximately its saturation temperature and an overheating part that overheats the working medium heated to the approximately saturation temperature. In such a case, the evaporation part and the overheating part may be configured independently or integrally. In the fifth embodiment, the water condensed from the vapor in the first heat source heat exchanger 11 or the second heat source heat exchanger 12 may be used as the lubricant for the bearing 70 of the rotation shaft 23. In the sixth embodiment, the compressor 90 may be provided on the rotation shaft 23 and the compressor 90 may be driven directly by the rotary machine drive system.

What is claimed is:

1. A rotary machine drive system, comprising:

a first heat source heat exchanger that receives a first heating medium and gasifies a liquid working medium;

a first expander that is connected to a rotation shaft and rotates the rotation shaft by expanding the working medium that has been gasified by the first heat source heat exchanger;

a rotary machine that has a rotor part provided to the rotation shaft;

a second heat source heat exchanger that receives a second heating medium and gasifies the liquid working medium;

a second expander that is connected to the rotation shaft and rotates the rotation shaft by expanding the working medium;

a joining portion, located downstream of both the first expander and the second expander in a flow direction of the working medium, where the working medium that has been gasified by the first heat source heat exchanger and expanded in the first expander is joined with the working medium that has been gasified by the second heat source heat exchanger and expanded in the second expander, to form a common flow of working medium;

a condenser system that receives the common flow of working medium; and a flow rate adjusting unit that adjusts a flow rate of the working medium flowing from the condenser system into the first heat source heat exchanger to be expanded in the first expander, and a flow rate of the working medium flowing from the condenser system into the second heat source heat exchanger to be expanded in the second expander, wherein when a heat amount of the first heating medium flowing into the first heat source heat exchanger is greater than a heat amount of the second heating medium flowing into the second heat source heat exchanger, the flow rate adjusting unit adjusts the flow rate of the working medium so that a greater amount of the working medium flows into the first heat source heat exchanger than the working medium flowing into the second heat source heat exchanger.

2. The rotary machine drive system according to claim 1, wherein the condenser system is configured by a condenser that condenses the working medium that has been expanded in the second expander, in addition to the working medium that has been expanded in the first expander.

* * * * *